US010242696B2

(12) United States Patent
Ebenezer

(10) Patent No.: US 10,242,696 B2
(45) Date of Patent: Mar. 26, 2019

(54) DETECTION OF ACOUSTIC IMPULSE EVENTS IN VOICE APPLICATIONS

(71) Applicant: Cirrus Logic International Semiconductor Ltd., Edinburgh (GB)

(72) Inventor: Samuel Pon Varma Ebenezer, Tempe, AZ (US)

(73) Assignee: Cirrus Logic, Inc., Austin, TX (US)

( * ) Notice: Subject to any disclaimer, the term of this patent is extended or adjusted under 35 U.S.C. 154(b) by 109 days.

(21) Appl. No.: 15/290,685

(22) Filed: Oct. 11, 2016

(65) Prior Publication Data

US 2018/0102135 A1 Apr. 12, 2018

(51) Int. Cl.

| | |
|---|---|
| ***G10L 21/02*** | (2013.01) |
| ***G10L 25/84*** | (2013.01) |
| ***G10L 21/0216*** | (2013.01) |
| ***G10L 21/0232*** | (2013.01) |

(52) U.S. Cl.

CPC ..... *G10L 25/84* (2013.01); *G10L 21/0232* (2013.01); *G10L 21/02* (2013.01); *G10L 2021/02166* (2013.01)

(58) Field of Classification Search

CPC ..... G10L 21/02; G10L 25/84; G10L 25/87; G10L 25/78

USPC ..... 704/226–227, 233

See application file for complete search history.

(56) References Cited

U.S. PATENT DOCUMENTS

| | | | | |
|---|---|---|---|---|
| 5,991,718 | A * | 11/1999 | Malah | G10L 25/78 704/208 |
| 6,240,381 | B1 * | 5/2001 | Newson | G10L 25/93 704/214 |
| 6,453,291 | B1 * | 9/2002 | Ashley | G10L 25/78 704/200 |
| 7,219,065 | B1 * | 5/2007 | Vandali | G10L 21/0364 704/200.1 |

(Continued)

FOREIGN PATENT DOCUMENTS

| | | |
|---|---|---|
| GB | 2456296 A | 7/2009 |
| KR | 101624926 B | 5/2016 |

(Continued)

OTHER PUBLICATIONS

Hsu, Chung-Chien, et al. "Voice activity detection based on frequency modulation of harmonics." Acoustics, Speech and Signal Processing (ICASSP), 2013 IEEE International Conference on. IEEE, Oct. 2013, pp. 6679-6683.*

(Continued)

*Primary Examiner* — James S Wozniak
(74) *Attorney, Agent, or Firm* — Jackson Walker L.L.P.

(57) ABSTRACT

In accordance with embodiments of the present disclosure, an integrated circuit for implementing at least a portion of an audio device may include an audio output configured to reproduce audio information by generating an audio output signal for communication to at least one transducer of the audio device, a microphone input configured to receive an input signal indicative of ambient sound external to the audio device and a processor configured to implement an (Continued)

impulsive noise detector. The impulsive noise detector may include a sudden onset detector for predicting an occurrence of a signal burst event of the input signal and an impulsive detector for determining whether the signal burst event comprises a speech event or a noise event.

12 Claims, 9 Drawing Sheets

(56) References Cited

U.S. PATENT DOCUMENTS

| | | | | |
|---|---|---|---|---|
| 7,492,889 | B2 | 2/2009 | Ebenezer | |
| 7,903,825 | B1 | 3/2011 | Melanson | |
| 8,126,706 | B2 | 2/2012 | Ebenezer | |
| 8,565,446 | B1 | 10/2013 | Ebenezer | |
| 8,804,974 | B1 | 8/2014 | Melanson | |
| 9,361,885 | B2 | 6/2016 | Ganong, III et al. | |
| 2003/0204394 | A1 | 10/2003 | Garudadri et al. | |
| 2004/0137846 | A1* | 7/2004 | Behboodian | G10L 19/012 455/63.1 |
| 2005/0108004 | A1 | 5/2005 | Otani et al. | |
| 2006/0100868 | A1* | 5/2006 | Hetherington | G10L 21/0208 704/226 |
| 2008/0077403 | A1* | 3/2008 | Hayakawa | G10L 15/20 704/233 |
| 2009/0125899 | A1* | 5/2009 | Unfried | G06F 8/67 717/168 |
| 2009/0154726 | A1* | 6/2009 | Taenzer | G10L 25/78 381/94.1 |
| 2010/0057453 | A1 | 3/2010 | Valsan | |
| 2010/0280827 | A1* | 11/2010 | Mukerjee | G10L 15/142 704/236 |
| 2010/0332221 | A1 | 12/2010 | Yamanashi et al. | |
| 2011/0153313 | A1 | 6/2011 | Etter | |
| 2011/0178795 | A1 | 7/2011 | Bayer et al. | |
| 2011/0264447 | A1 | 10/2011 | Visser et al. | |
| 2011/0305347 | A1* | 12/2011 | Wurm | G10K 11/178 381/71.1 |
| 2012/0076311 | A1* | 3/2012 | Isabelle | G10L 21/0208 381/57 |
| 2013/0132076 | A1 | 5/2013 | Yang et al. | |
| 2013/0259254 | A1* | 10/2013 | Xiang | G10K 11/175 381/73.1 |
| 2013/0301842 | A1* | 11/2013 | Hendrix | G10K 11/002 381/71.1 |
| 2014/0270260 | A1* | 9/2014 | Goertz | G10L 25/84 381/110 |
| 2015/0070148 | A1 | 3/2015 | Cruz-Hernandez et al. | |
| 2015/0081285 | A1 | 3/2015 | Sohn et al. | |
| 2015/0348572 | A1* | 12/2015 | Thornburg | G10L 25/84 704/219 |
| 2015/0371631 | A1 | 12/2015 | Weinstein et al. | |
| 2015/0380013 | A1 | 12/2015 | Nongpiur | |
| 2016/0029121 | A1* | 1/2016 | Nesta | G10L 19/008 381/71.1 |
| 2016/0093313 | A1 | 3/2016 | Vickers | |
| 2016/0118056 | A1 | 4/2016 | Choo et al. | |
| 2016/0133264 | A1* | 5/2016 | Mani | G10L 19/06 704/205 |
| 2016/0210987 | A1 | 7/2016 | Sugiyama | |
| 2017/0025132 | A1 | 1/2017 | Moriya et al. | |
| 2017/0040016 | A1 | 2/2017 | Cui et al. | |
| 2017/0110115 | A1 | 4/2017 | Song et al. | |
| 2017/0229117 | A1 | 8/2017 | van der Made et al. | |
| 2017/0263240 | A1 | 9/2017 | Kalinli-Akbacak | |
| 2018/0068654 | A1 | 3/2018 | Cui et al. | |
| 2018/0102135 | A1 | 4/2018 | Ebenezer | |
| 2018/0102136 | A1 | 4/2018 | Ebenezer | |

FOREIGN PATENT DOCUMENTS

| | | | |
|---|---|---|---|
| KR | 20160073874 | A | 6/2016 |
| KR | 101704926 | B | 2/2017 |
| WO | 2013142659 | A2 | 9/2013 |
| WO | 2017027397 | A2 | 2/2017 |

OTHER PUBLICATIONS

Sasaoka, Naoto, Kazumasa Ono, and Yoshio Itoh. "Speech enhancement based on 4th order cumulant backward linear predictor for impulsive noise." Signal Processing (ICSP), 2012 IEEE 11th International Conference on. vol. 1. IEEE, Oct. 2012, pp. 127-131.*

Combined Search and Examination Report under Sections 17 and 18(3), Application No. GB1619678.4, dated Apr. 10, 2017.

Bello, Juan Pablo et al., A Tutorial on Onset Detection in Music Signals, IEEE Transactions on Speech and AUdio Processing, vol. 13, No. 5, Sep. 2005, pp. 1035-1047.

Dibiase, et al., Robust Localization in Reverberant Rooms, pp. 158-160.

Deller, Jr., J.R. et al., Discrete-Time Processing of Speech Signals, Wiley-IEEE press, 1999.

Kay, S.M., Fundamentals of Statistical Signal Processing, vol. II: Detection Theory, Prentice Hall, 1998.

Kulkarni, Sanjeev R. et al., Statistical Learning Theory: A Tutorial, Feb. 20, 2011, pp. 1-25.

Wisdom, Scott et al., Voice Activity Detection Using Subband Noncircularity, Proc. IEEE ICASSP, Brisbane, Australia, Apr. 2015.

Woo, H.K. et al., Robust voice activity detection algorithm for estimating noise spectrum, Electronics Letters, vol. 36, No. 2, pp. 180-181, 2000.

Search Report, UKIPO, Application No. GB1716561.4, dated Apr. 3, 2018.

Potamitis, I et al., "Impulsive noise suppression using neural networks", Acoustics, Speech, and Signal Processing 000, ICASSP '00, Proceedings, 2000 IEEE International Conference on Jun. 5-9, 2000, Piscataway, NJ, vol. 3, Jun. 5, 2000, pp. 1871-1874.

Ruhland, Marco et al., "Reduction of gaussian, supergaussian, and impulsive noise by interpolation of the binary mask residual", IEEE/ACM Transactions on Audio, Speech, and Language Processing, IEEE, vol. 23, No. 10, Oct. 1, 2015, pp. 1680-1691.

Czyzewski, Andrzej, "Learning Algorithms for Audio Signal Enhancement, Part 1: Neural Network Implementation for the Removal of Impulse Distortions", JAES vol. 45, No. 10, Oct. 31, 1997, pp. 815-831.

International Search Report and Written Opinion of the International Searching Authority, International Application No. PCT/US2017/055887, dated Feb. 2, 2018.

Manohar et al., "Speech enhancement in nonstationary noise environments using noise properties." Speech Communication 48.1, Jan. 2006, pp. 96-109.

Ahmed, Rehana et al., "Speech Source Separation Using a Multi-Pitch Harmonic Product Spectrum-Based Algorithm," Audio Engineering Society Convention 130, Audio Engineering Society, May 2011, pp. 1-6.

Bell, Peter et al., "The UEDIN ASR Systems for the IWSLT 2014 Evaluation," Proc. IWSLT, Dec. 2014, pp. 1-9.

Silvasankaran, Sunit et al., "Robust ASR Using Neural Network Based Speech Enhancement and Feature Simulation," Automatic Speech Recognition and Understanding (ASRU), 2015 IEEE Workshop on, IEEE, Dec. 2015, pp. 1-8.

Zhuang, Xiaodan et al., "Real-world Acoustic Event Detection," Pattern Recognition Letters 31.12, Sep. 2010, pp. 1543-1551.

* cited by examiner

DETECTION OF ACOUSTIC IMPULSE EVENTS IN VOICE APPLICATIONS

TECHNICAL FIELD

The field of representative embodiments of this disclosure relates to methods, apparatuses, and implementations concerning or relating to voice applications in an audio device. Applications include detection of acoustic impulsive noise events based on the harmonic and sparse spectral nature of speech.

BACKGROUND

Voice activity detection (VAD), also known as speech activity detection or speech detection, is a technique used in speech processing in which the presence or absence of human speech is detected. VAD may be used in a variety of applications, including noise suppressors, background noise estimators, adaptive beamformers, dynamic beam steering, always-on voice detection, and conversation-based playback management. In many of such applications, high-energy and transient background noises that are often present in an environment are impulsive in nature. Many traditional VADs rely on changes in signal level on a full-band or sub-band basis and thus often detect such impulsive noise as speech, as a signal envelope of an impulsive noise is often similar to that of speech. In addition, in many cases an impulsive noise spectrum averaged over various impulsive noise occurrences and an averaged speech spectrum may not be significantly different. Accordingly, in such systems, impulsive noise may be detected as speech, which may deteriorate system performance. For example, in a beam-steering application, false detection of an impulse noise as speech may result in steering a "look" direction of the beam-steering system in an incorrect direction even though an individual speaking is not moving relative to the audio device.

SUMMARY

In accordance with the teachings of the present disclosure, one or more disadvantages and problems associated with existing approaches to voice activity detection may be reduced or eliminated.

In accordance with embodiments of the present disclosure, an integrated circuit for implementing at least a portion of an audio device may include an audio output configured to reproduce audio information by generating an audio output signal for communication to at least one transducer of the audio device, a microphone input configured to receive an input signal indicative of ambient sound external to the audio device, and a processor configured to implement an impulsive noise detector. The impulsive noise detector may include a sudden onset detector for predicting an occurrence of a signal burst event of the input signal and an impulse detector for determining whether the signal burst event comprises a speech event or a noise event.

In accordance with these and other embodiments of the present disclosure, a method for impulsive noise detection may include receiving an input signal indicative of ambient sound external to an audio device, predicting an occurrence of a signal burst event of the input signal, and determining whether the signal burst event comprises a speech event or a noise event.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the example, present embodiments and certain advantages thereof may be acquired by referring to the following description taken in conjunction with the accompanying drawings, in which like reference numbers indicate like features, and wherein.

DETAILED DESCRIPTION

Figure 1:
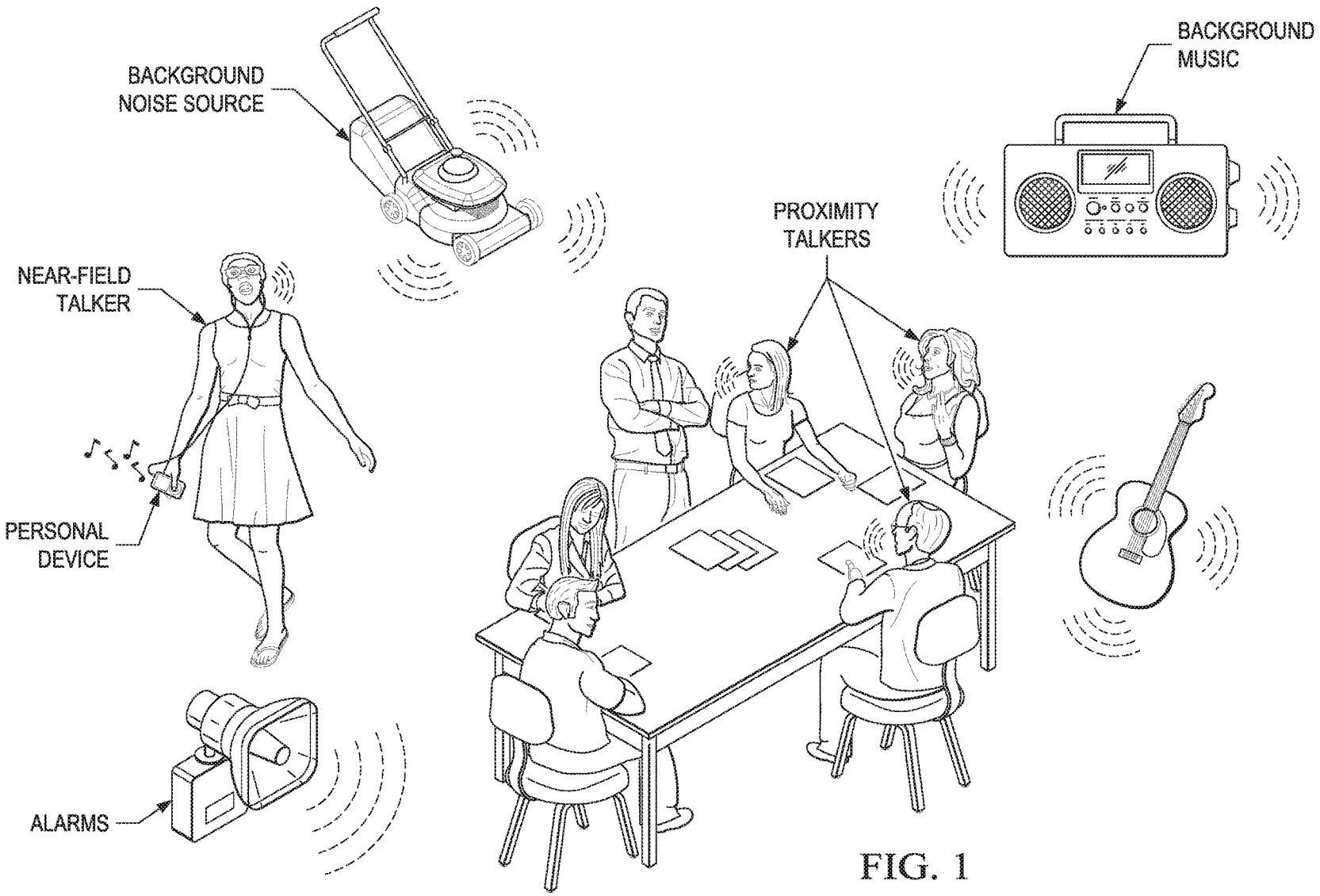
FIG. 1 illustrates an example of a use case scenario wherein various detectors may be used in conjunction with a playback management system to enhance a user experience, in accordance with embodiments of the present disclosure.

In accordance with embodiments of this disclosure, an automatic playback management framework may use one or more audio event detectors. Such audio event detectors for an audio device may include a near-field detector that may detect when sounds in the near-field of the audio device are detected, such as when a user of the audio device (e.g., a user that is wearing or otherwise using the audio device) speaks, a proximity detector that may detect when sounds in proximity to the audio device are detected, such as when another person in proximity to the user of the audio device speaks, and a tonal alarm detector that detects acoustic alarms that may have been originated in the vicinity of the audio device. FIG. 1 illustrates an example of a use case scenario wherein such detectors may be used in conjunction with a playback management system to enhance a user experience, in accordance with embodiments of the present disclosure.

Figure 2:
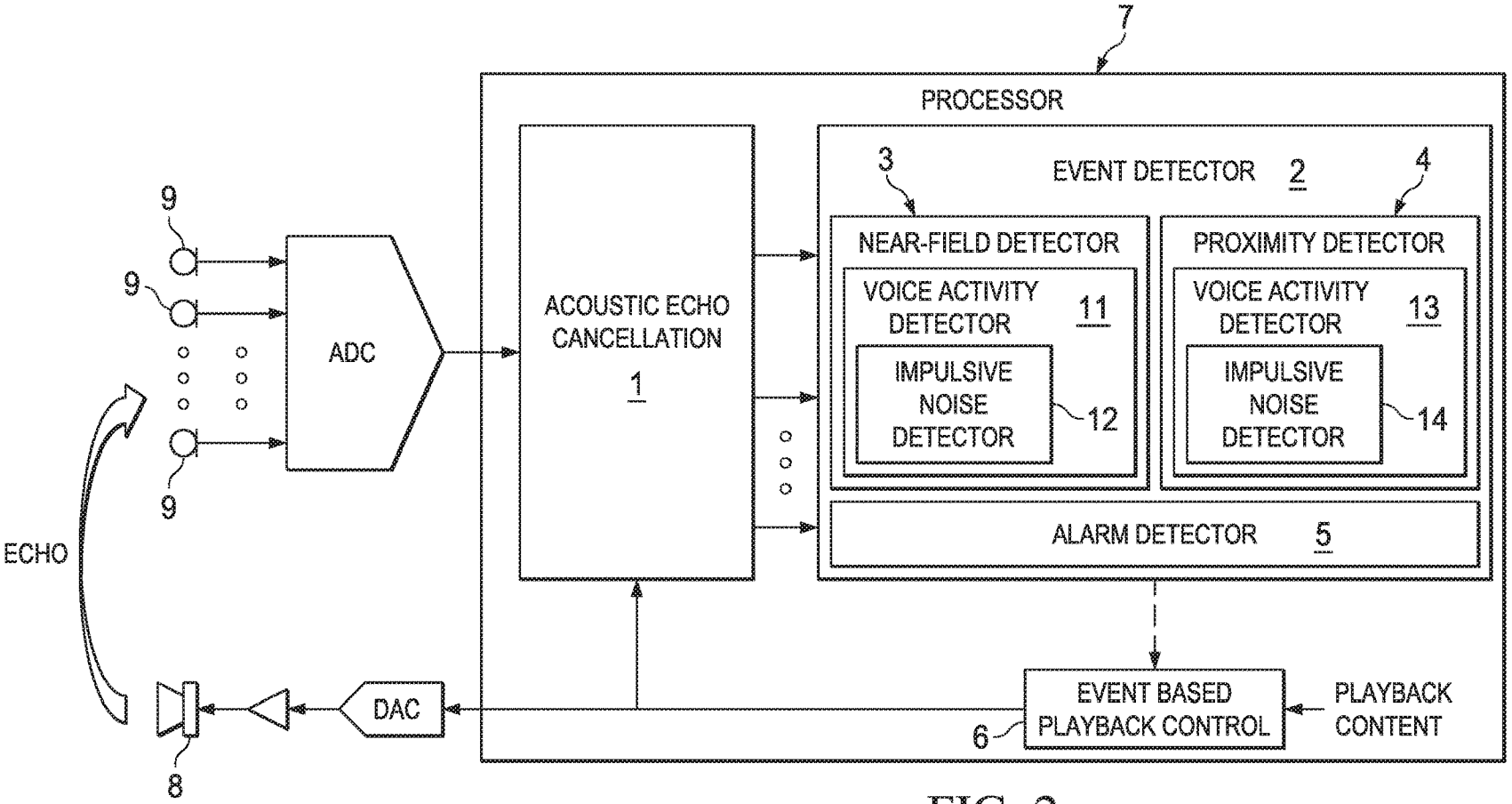
FIG. 2 illustrates an example playback management system, in accordance with embodiments of the present disclosure.

FIG. 2 illustrates an example playback management system that modifies a playback signal based on a decision from an event detector 2, in accordance with embodiments of the present disclosure. Signal processing functionality in a processor 7 may comprise an acoustic echo canceller 1 that may cancel an acoustic echo that is received at microphones 9 due to an echo coupling between an output audio transducer 8 (e.g., loudspeaker) and microphones 9. The echo reduced signal may be communicated to event detector 2 which may detect one or more various ambient events, including without limitation a near-field event (e.g., including but not limited to speech from a user of an audio device) detected by near-field detector 3, a proximity event (e.g., including but not limited to speech or other ambient sound other than near-field sound) detected by proximity detector 4, and/or a tonal alarm event detected by alarm detector 5. If an audio event is detected, an event-based playback control 6 may modify a characteristic of audio information (shown as "playback content" in FIG. 2) reproduced to output audio transducer 8. Audio information may include any information that may be reproduced at output audio transducer 8, including without limitation, downlink speech associated with a telephonic conversation received via a communication network (e.g., a cellular network) and/or internal audio from an internal audio source (e.g., music file, video file, etc.).

As shown in FIG. 2, near-field detector 3 may include a voice activity detector 11 which may be utilized by near-field detector 3 to detect near-field events. Voice activity detector 11 may include any suitable system, device, or apparatus configured to perform speech processing to detect the presence or absence of human speech. In accordance with such processing, voice activity detector 11 may include an impulsive noise detector 12. In operation, as described in greater detail below, impulsive noise detector 12 may predict an occurrence of a signal burst event of an input signal indicative of ambient sound external to an audio device (e.g., a signal induced by sound pressure on one or more microphones 9) to determine whether the signal burst event comprises a speech event or a noise event.

As shown in FIG. 2, proximity detector 4 may include a voice activity detector 13 which may be utilized by proximity detector 4 to detect events in proximity with an audio device. Similar to voice activity detector 11, voice activity detector 13 may include any suitable system, device, or apparatus configured to perform speech processing to detect the presence or absence of human speech. In accordance with such processing, voice activity detector 13 may include an impulsive noise detector 14. Similar to impulsive noise detector 12, impulsive noise detector 14 may predict an occurrence of a signal burst event of an input signal indicative of ambient sound external to an audio device (e.g., a signal induced by sound pressure on one or more microphones 9) to determine whether the signal burst event comprises a speech event or a noise event. In some embodiments, processor 7 may include a single voice activity detector having a single impulsive noise detector leveraged by both of near-field detector 3 and proximity detector 4 in performing their functionality.

Figure 3:
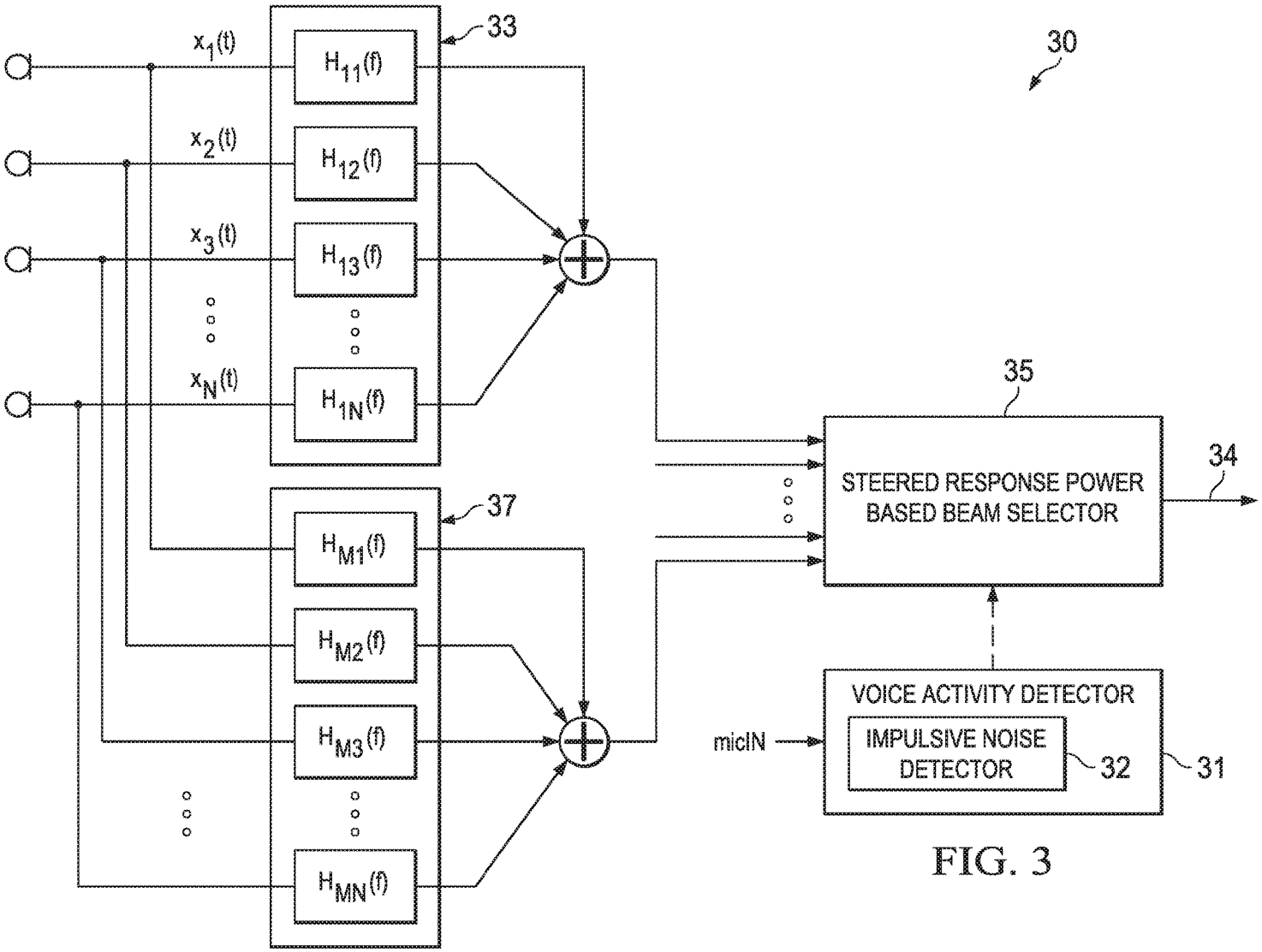
FIG. 3 illustrates an example steered response power based beamsteering system, in accordance with embodiments of the present disclosure.

FIG. 3 illustrates an example steered response power-based beamsteering system 30, in accordance with embodiments of the present disclosure. Steered response power-based beamsteering system 30 may operate by implementing multiple beamformers 33 (e.g., delay-and-sum and/or filter-and-sum beamformers) each with different look direction such that the entire bank of beamformers 33 will cover the desired field of interest. The beamwidth of each beamformer may depend on a microphone array aperture length. An output power from each beamformer may be computed, and a beamformer 33 having a maximum output power may be switched to an output path 34 by a beam selector 35. Switching of beam selector 35 may be constrained by a voice activity detector 31 having an impulsive noise detector 32 such that the output power is measured by beam selector 35 only when speech is detected, thus preventing beam selector 35 from rapidly switching between multiple beamformers 33 by responding to spatially non-stationary background impulsive noises.

Figure 4:
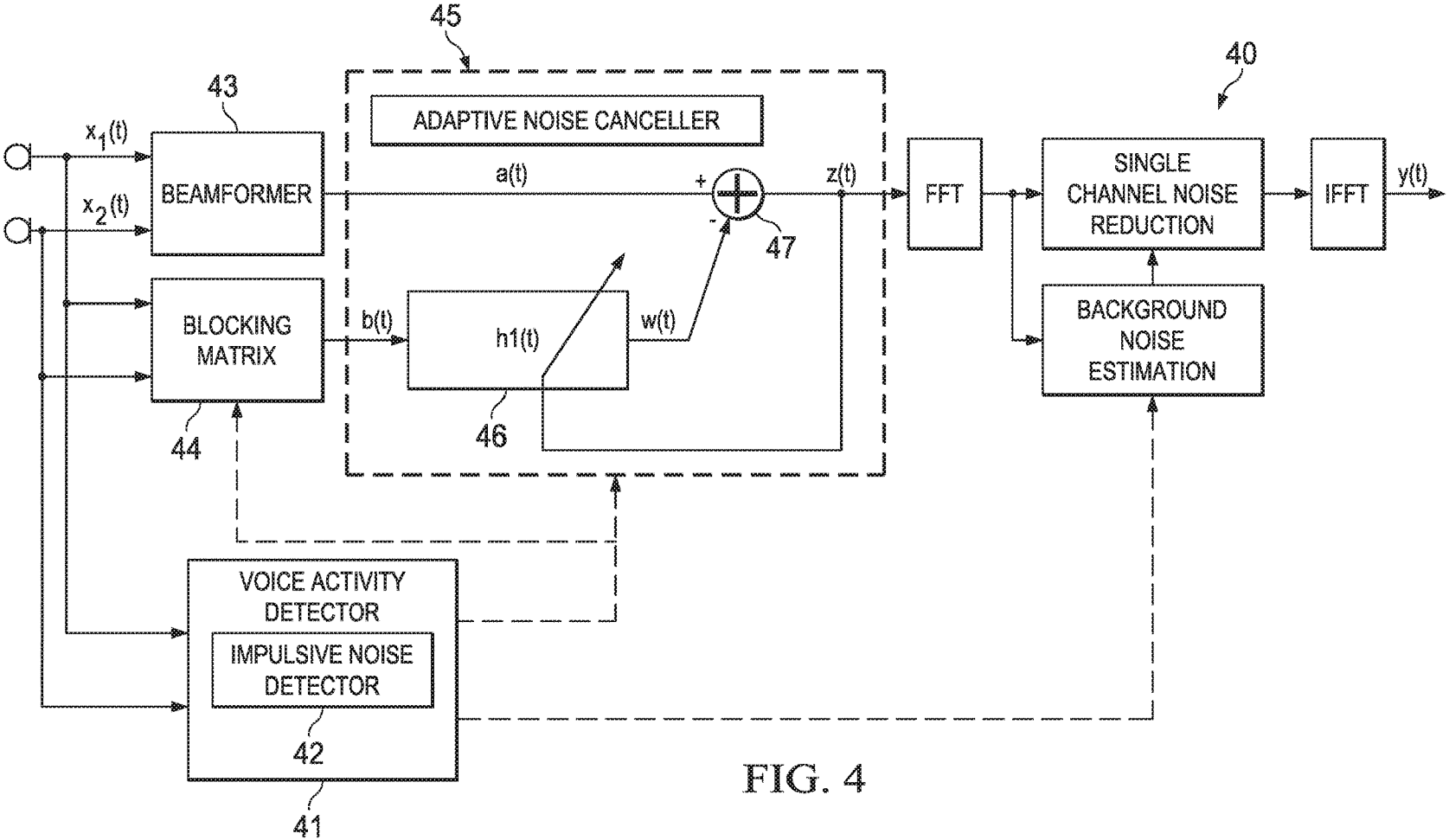
FIG. 4 illustrates an example adaptive beamformer, in accordance with embodiments of the present disclosure.

FIG. 4 illustrates an example adaptive beamformer 40, in accordance with embodiments of the present disclosure. Adaptive beamformer 40 may comprise any system, device, or apparatus capable of adapting to changing noise conditions based on the received data. In general, an adaptive beamformer may achieve higher noise cancellation or interference suppression compared to fixed beamformers. As shown in FIG. 4, adaptive beamformer 40 is implemented as a generalized side lobe canceller (GSC). Accordingly, adaptive beamformer 40 may comprise a fixed beamformer 43, blocking matrix 44, and a multiple-input adaptive noise canceller 45 comprising an adaptive filter 46. If adaptive filter 46 were to adapt at all times, it may train to speech leakage also causing speech distortion during a subtraction stage 47. To increase robustness of adaptive beamformer 40, a voice activity detector 41 having an impulsive noise detector 42 may communicate a control signal to adaptive filter 46 to disable training or adaptation in the presence of speech. In such implementations, voice activity detector 41 may control a noise estimation period wherein background noise is not estimated whenever speech is present. Similarly, the robustness of a GSC to speech leakage may be further improved by using an adaptive blocking matrix, the control for which may include an improved voice activity detector with an impulsive noise detector, as described in U.S. patent application Ser. No. 14/871,688 entitled "Adaptive Block Matrix Using Pre-Whitening for Adaptive Beam Forming."

Figure 5:
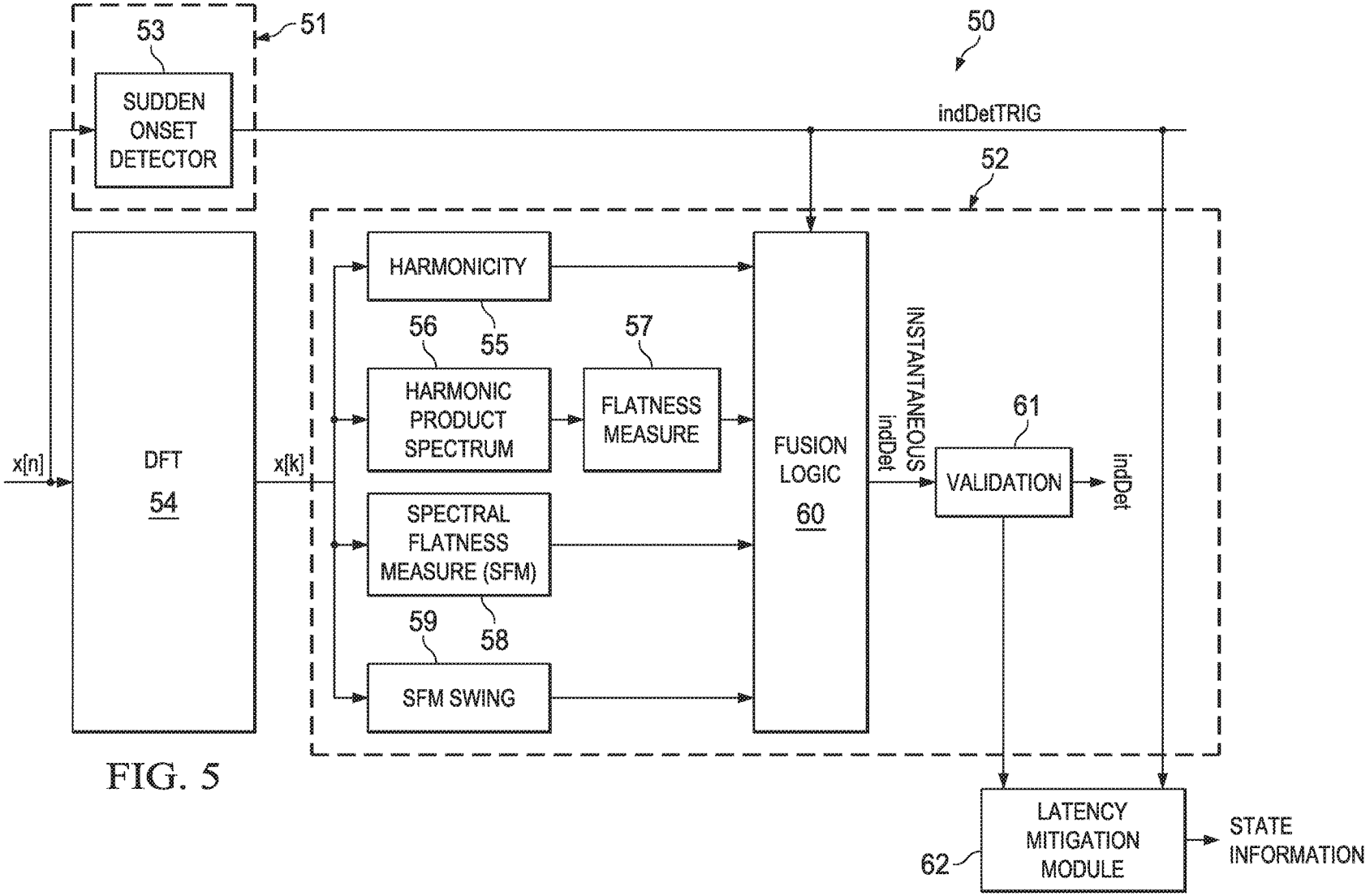
FIG. 5 illustrates a block diagram of an impulsive noise detector, in accordance with embodiments of the present disclosure.

FIG. 5 illustrates a block diagram of an impulsive noise detector 50, in accordance with embodiments of the present disclosure. In some embodiments, impulsive noise detector 50 may implement one or more of impulsive noise detector 12, impulsive noise detector 14, impulsive noise detector 32, and impulsive noise detector 42. Impulsive noise detector 50 may comprise any suitable system, device, or apparatus configured to exploit the harmonic nature of speech to distinguish impulsive noise from speech, as described in greater detail below.

As shown in FIG. 5, impulsive noise detector 50 may comprise two processing stages 51 and 52. A first processing stage 51 may comprise a sudden onset detector 53 that predicts an occurrence of a signal burst event of an input audio signal x[n] (e.g., a signal indicative of sound pressure present upon a microphone) and a second processing stage 52 may comprise an impulse detector for determining whether the signal burst event comprises a speech event or a noise event by analyzing based on harmonicity, sparsity, and degree of temporal modulation of a signal spectrum of input audio signal x[n] to determine whether the signal burst event comprises a speech event or a noise, as described in greater detail below.

Such two-stage approach may be advantageous in a number of applications. For example, use of such approach may be advantageous in always-on voice applications due to stringent power consumption requirements of audio devices. Using the two-stage approach described herein, first processing stage 51 may be computationally inexpensive, but robust, while second processing stage 52 may be more computationally expensive, but may be executed only when a possible signal burst event is detected by first processing stage 51. In addition, the two-stage approach of impulsive noise detector 50 may also be used in conjunction with existing voice activity detectors to complement overall system performance of a voice application.

Sudden onset detector 53 may comprise any system, device, or apparatus configured to exploit sudden changes in a signal level of input audio signal x[n] in order to predict a forthcoming signal burst. For example, samples of input audio signal x[n] may first be grouped into overlapping frame samples and the energy of each frame computed. Sudden onset detector 53 may calculate the energy of a frame as:

$$E[l] = \sum_{n=1}^{N} x^2[n, l]$$

where N is the total number of samples in a frame, l is the frame index, and a predetermined percentage (e.g., 25%) of overlapping is used to generate each frame. Further, sudden onset detector 53 may calculate a normalized frame energy as:

$$\hat{E}[m, l] = \frac{E[m]}{\max_{\forall m} E[m] - \min_{\forall m} E[m]}$$

where m=l, l-1, l-2, . . . , l-L+1 and L is a size of the frame energy history buffer. The denominator in this normalization step may represent a dynamic range of frame energy over the current and past (L−1) frames. Sudden onset detector 53 may then compute a sudden onset statistic as:

$$\gamma_{OS}[l] = \frac{\max_{\forall m'} \hat{E}[m', l]}{\hat{E}[l, l]}$$

where m'=l-1, l-2, . . . , l-L+1. One of skill in the art may note that the maximum is computed only over the past (L−1) frames. Therefore, if a sudden acoustic event appears in the environment, the frame energy at the onset of the event may be high and the maximum energy over the past (L−1) frames may be smaller than the maximum value. Therefore, the ratio of these two values may be small during the onset. Accordingly, the frame size should be such that the past (L−1) frames do not contain energy corresponding to the signal burst.

Sudden onset detector 53 may define a sudden onset test statistic as:

$$\text{sudden onset detect} = \begin{cases} \text{True}, & \begin{matrix} \gamma_{OS}[l] < Th_{OS} \\ E[l] > Th_E \end{matrix} \\ \text{False}, & \text{otherwise} \end{cases}$$

where $Th_{OS}$ is the threshold for the sudden onset statistic and $Th_E$ is the energy threshold. The energy threshold condition may reduce false alarms that may be generally high for very low energy signals, for the reason that any small change in the signal energy can trigger sudden onset detection. Sudden onset detector 53 may normalize frame energies by the dynamic range of audio input signal x[n] to keep the threshold, $Th_{OS}$ independent of the absolute signal level.

Because sudden onset detector 53 detects signal level fluctuations, an onset detect signal indDetTrig may also be triggered for sudden speech bursts. For example, onset detect signal indDetTrig may be triggered every time a speech event appears after a period of silence. Accordingly, impulsive noise detector 50 cannot rely solely on sudden onset detector 53 to accurately detect an impulsive noise. Accordingly, once a high energy signal onset is detected by the sudden onset detector 53, the impulsive detector of second processing stage 52 may exploit the harmonic and sparse nature of an instantaneous speech spectrum to determine if the signal onset is caused by speech or impulsive noise. For example, second processing stage 52 may use a number of parameters, including harmonicity, harmonic product spectrum flatness measure, spectral flatness measure, and/or spectral flatness measure swing of audio input signal x[n] that extract either the sparsity or the harmonicity level of a given input signal spectrum of audio input signal x[n].

In order to extract spectral information of audio input signal x[n] in order to determine values of such parameters, impulsive noise detector 50 may convert audio input signal x[n] from the time domain to the frequency domain by means of a discrete Fourier transform (DFT) 54. DFT 54 may buffer, overlap, window, and convert audio input signal x[n] to the frequency domain as:

$$X[k, l] = \sum_{n=0}^{N-1} w[n]x[n, l]e^{\frac{-j2\pi nk}{N}}, k = 0, 1, \ldots, N-1,$$

where w[n] is a windowing function, x[n,l] is a buffered and overlapped input signal frame, N is a size of the DFT size and k is a frequency bin index. The overlap may be fixed at any suitable percentage (e.g., 25%).

To calculate the harmonicity and sparsity parameters described above, second processing stage 52 may include a harmonicity calculation block 55, a harmonic product spectrum block 56, a harmonic flatness measure block 57, a spectral flatness measure (SFM) block 58, and a SFM swing block 59.

To determine harmonicity, harmonicity calculation block 55 may compute total power in a frame as:

$$E_x[l] = \sum_{k \in \mathcal{K}} |X[k, l]|^2$$

where $\mathcal{K}$ is a set of all frequency bin indices corresponding to the spectral range of interest. Harmonicity calculation block 55 may calculate a harmonic power as:

$$E_H[p, l] = \sum_{m=1}^{N_h} |X[mp, l]|^2, p \in \mathcal{P}$$

where $N_h$ is a number of harmonics, m is a harmonic order, and $\mathcal{P}$ is a set of all frequency bin indices corresponding to an expected pitch frequency range. The expected pitch frequency range may be set to any suitable range (e.g., 100-500 Hz). A harmonicity at a given frequency may be defined as a ratio of the harmonic power to the total energy without the harmonic power and harmonicity calculation block 55 may calculate harmonicity as:

$$H[p, l] = \frac{E_H[p, l]}{E_x[l] - E_H[p, l]}.$$

For clean speech signals, harmonicity may have a maximum at the pitch frequency. Because an impulsive noise spectrum may be less sparse than a speech spectrum, harmonicity for impulsive noises may be small. Thus, a harmonicity calculation block 55 may output a harmonicity-based test statistic formulated as:

$$\gamma_{Harm}[l] = \max_{\forall p \in \mathcal{P}} H[p,l].$$

In many instances, most of impulsive noises corresponding to transient acoustic events tend to have more energy at lower frequencies. Moreover, the spectrum may also typically be less sparse at these lower frequencies. On the other hand, a spectrum corresponding to voiced speech also has more low-frequency energy. However, in most instances, a speech spectrum has more sparsity than impulsive noises. Therefore, one can examine the flatness of the spectrum at these lower frequencies as a deterministic factor. Accordingly, SFM block 58 may calculate a sub-band spectral flatness measure computed as:

$$\gamma_{SFM}[l] = \frac{\prod_{k=N_L}^{N_H} [|X[k, l]|^2]^{1/N_B}}{\frac{1}{N_B} \sum_{k=N_L}^{N_H} |X[k, l]|^2}$$

where $N_B = N_H - N_L + 1$, $N_H$ and $N_L$ are the spectral bin indices corresponding to low- and high-frequency band edges respectively, of a sub-band. The sub-band frequency range may be of any suitable range (e.g., 500-1500 Hz).

An ability of second processing stage 52 to differentiate speech from impulsive noise based on harmonicity may degrade when non-impulsive background noise is also present in an acoustic environment. Under such conditions, harmonic product spectrum block 56 may provide more robust harmonicity information. Harmonic product spectrum block 56 may calculate a harmonic product spectrum as:

$$G[p, l] = \prod_{m=1}^{N_h} |X[mp, l]|^2, \; p \in \mathcal{P}$$

where $N_h$ and $\mathcal{P}$ are defined above with respect to the calculation of harmonicity. The harmonic product spectrum tends to have a high value at the pitch frequency since the pitch frequency harmonics are accumulated constructively, while at other frequencies, the harmonics are accumulated destructively. Therefore, the harmonic product spectrum is a sparse spectrum for speech, and it is less sparse for impulsive noise because the noise energy in impulsive noise distributes evenly across all frequencies. Therefore, a flatness of the harmonic product spectrum may be used as a differentiating factor. Harmonic flatness measure block 57 may compute a flatness measure of the harmonic product spectrum is as:

$$\gamma_{HPS-SFM}[l] = \frac{\prod_{p \in \mathcal{P}} [|G[p, l]|^2]^{1/N_{\mathcal{P}}}}{\frac{1}{N_{\mathcal{P}}} \sum_{p \in \mathcal{P}} |G[p, l]|^2}$$

where $N_{\mathcal{P}}$ is the number of spectral bins in the pitch frequency range.

An impulsive noise spectrum may exhibit spectral stationarity over a short period of time (e.g., 300-500 ms), whereas a speech spectrum may vary over time due to spectral modulation of pitch harmonics. Once a signal burst onset is detected, SFM swing block 59 may capture such non-stationarity information by tracking spectral flatness measures from multiple sub-bands over a period of time and estimate the variation of the weighted and cumulative flatness measure over the same period. For example, SFM swing block 59 may track a cumulative SFM over a period of time and may calculate a difference between the maximum and the minimum cumulative SFM value over the same duration, such difference representing a flatness measure swing. The flatness measure swing value may generally be small for impulsive noises because the spectral content of such signals may be wideband in nature and may tend to be stationary for a short interval of time. The value of the flatness measure swing value may be higher for speech signals because spectral content of speech signal may vary faster than impulsive noises. SFM swing block 59 may calculate the flatness measure swing by first computing the cumulative spectral flatness measure as:

$$\rho_{SFM}[l] = \sum_{i=1}^{N_s} \alpha(i) \left\{ \frac{\prod_{k=N_L(i)}^{N_H(i)} [|X[k, l]|^2]^{1/N_B(i)}}{\frac{1}{N_B(i)} \sum_{k=N_L(i)}^{N_H(i)} |X[k, l]|^2} \right\}$$

where $N_B(i) = N_H(i) - N_L(i) + 1$, i is a sub-band number, $N_s$ is a number of sub-bands, $\alpha(i)$ is a sub-band weighting factor, $N_H(i)$ and $N_L(i)$ are spectral bin indices corresponding to the low- and high-frequency band edges, respectively of $i^{th}$ sub-band. Any suitable sub-band ranges may be employed (e.g., 500-1500 Hz, 1500-2750 Hz, and 2750-3500 Hz). SFM swing block 59 may then smooth the cumulative spectral flatness measure as:

$$\mu_{SFM}[l] = \beta * \mu_{SFM}[l-1] + (1-\beta)\rho_{SFM}[l]$$

where $\beta$ is the exponential averaging smoothing coefficient. SFM swing block 59 may obtain the spectral flatness measure swing by computing a difference between a maximum and a minimum spectral flatness measure value over the most-recent M frames. Thus, SFM swing block 59 may generate a spectral flatness measure swing-based test statistic defined as:

$$\gamma_{SFM\text{-}Swing}[l] = \max_{\forall m=l,l-1,l-M+1} \mu_{SFM}[m] - \min_{\forall m=l,l-1,l-M+1} \mu_{SFM}[m].$$

Because overlap of the foregoing parameters may be small, fusion logic 60 may apply a deterministic function that optimally separates speech and noise via one of many classification algorithms. For example, the feature vector corresponding to an $l^{th}$ frame may be given by:

$$v: [\gamma_{Harm}[l] \gamma_{SFM}[l] \gamma_{HPS-SFM}[l] \gamma_{SFMSwing}[l]]^T.$$

Figure 6A:
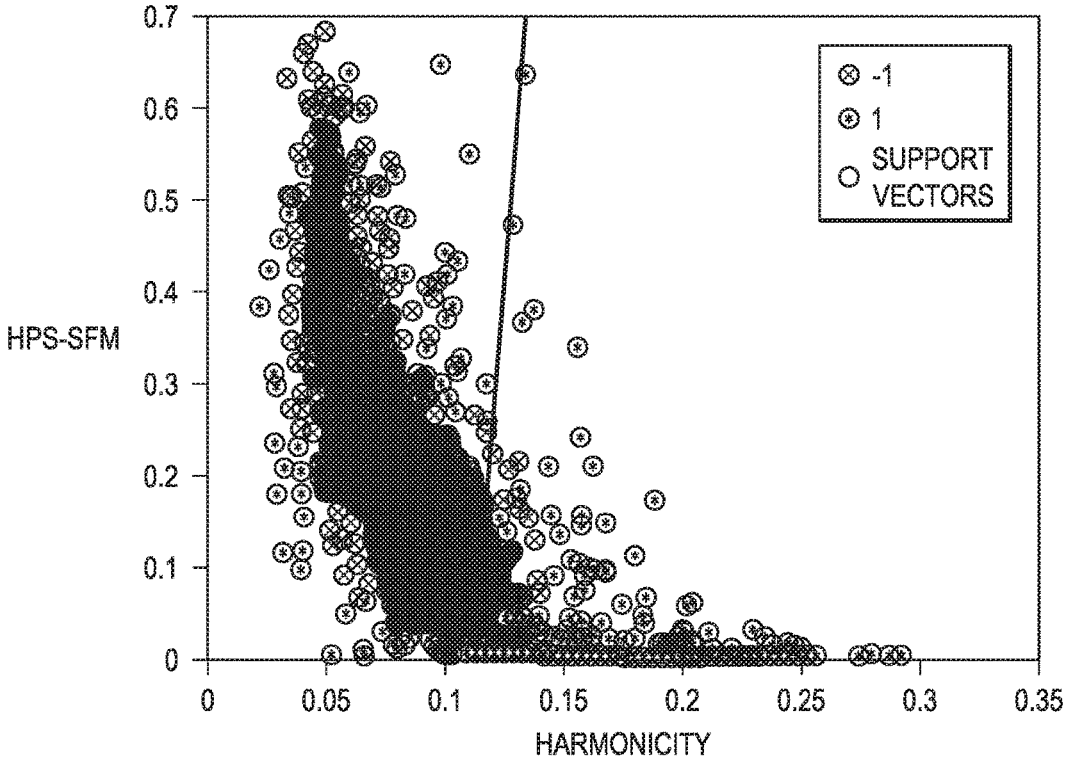
FIGS. 6A-6F graphically illustrate distribution of pairwise statistics and a decision boundary generated by a support vector machine, in accordance with embodiments of the present disclosure.
Figure 6B:
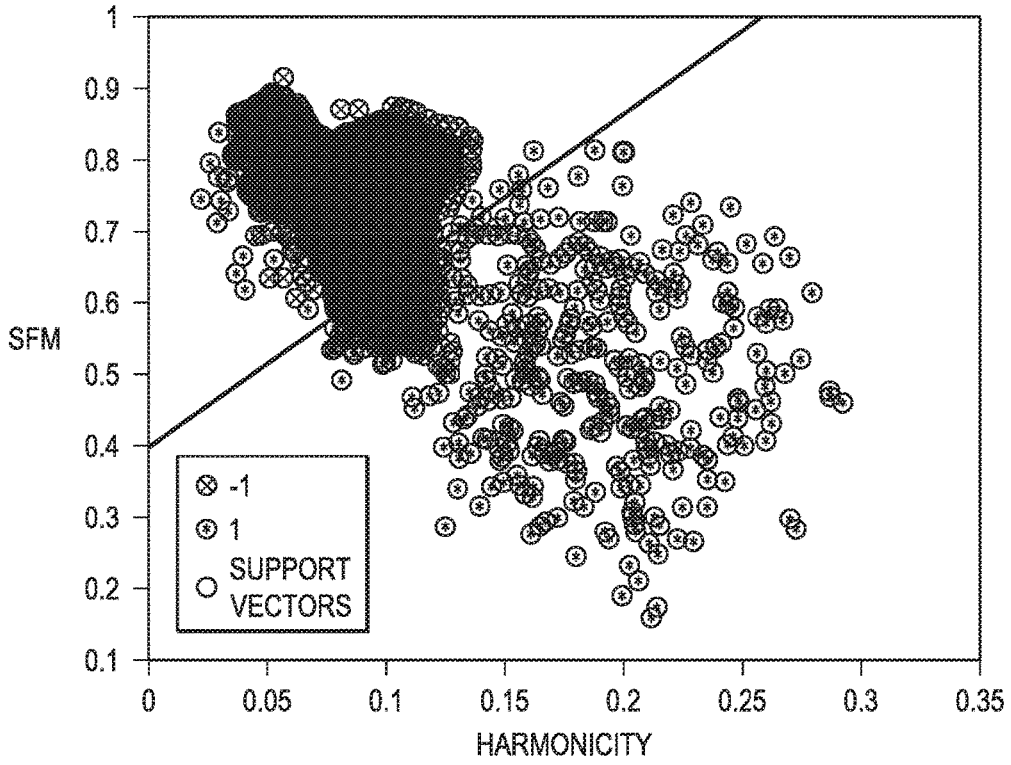
Figure 6C:
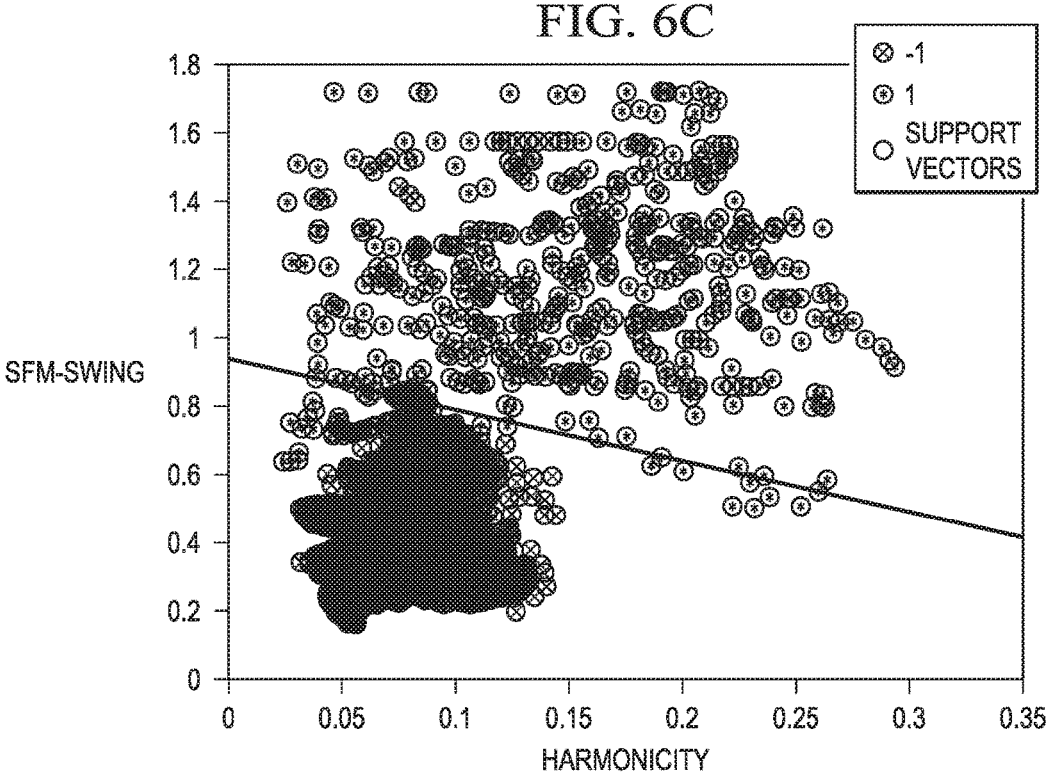
Figure 6D:
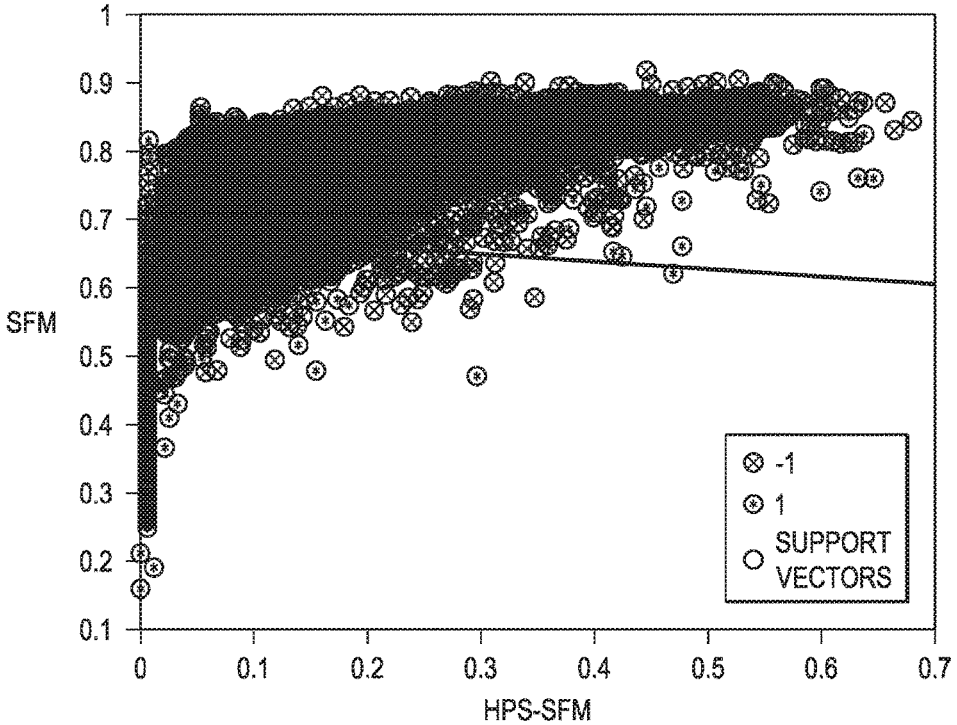
Figure 6E:
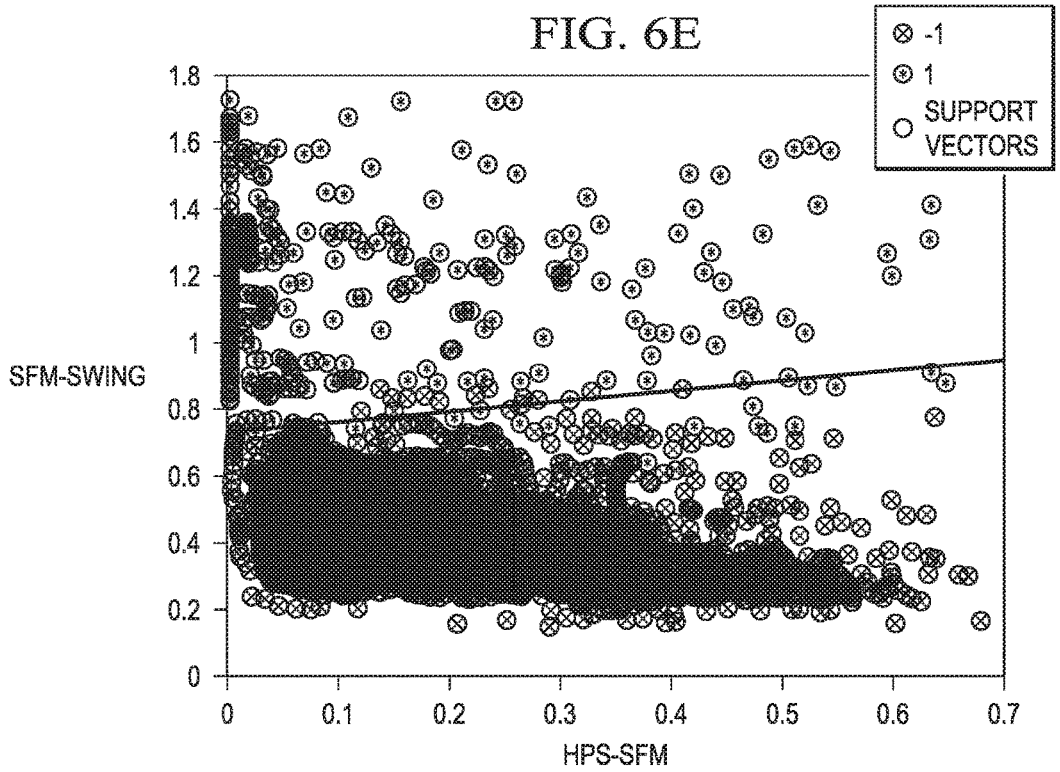
Figure 6F:
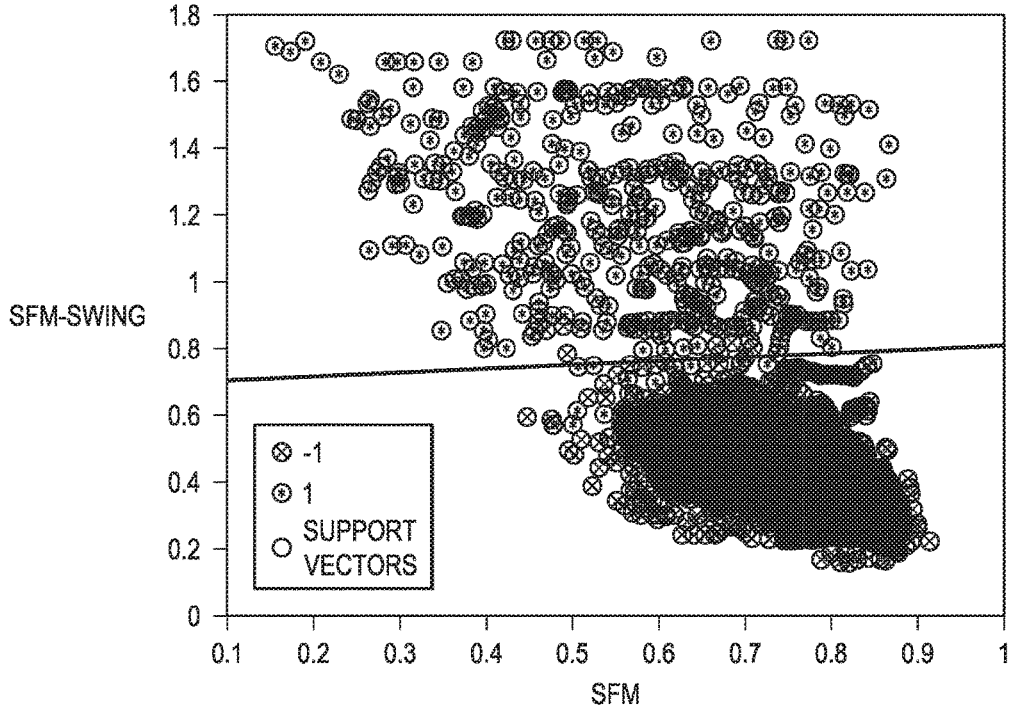

Fusion logic 60 may apply a supervised learning algorithm such as, for example, a support vector machine (SVM) to determine a non-linear function that optimally separates speech and impulse noise in a four-dimensional feature space, $\Re^4$, each dimension of the feature space corresponding to one of the foregoing parameters (e.g., harmonicity, harmonic product spectrum flatness measure, spectral flatness measure, and spectral flatness measure swing). For example, FIGS. 6A-6F show the distribution of pair-wise statistics and the decision boundary generated by the SVM (e.g., linear kernel) when only two of the four statistics are used. For example, FIG. 6A depicts pair-wise statistics and a decision boundary (shown with a straight line) for harmonic product spectrum flatness measure (HPS-SFM) and harmonicity, FIG. 6B depicts pair-wise statistics and a decision boundary (shown with a straight line) for spectral flatness measure (SFM) and harmonicity, FIG. 6C depicts pair-wise statistics and a decision boundary (shown with a straight line) for spectral flatness measure swing (SFM-SWING), FIG. 6D depicts pair-wise statistics and a decision boundary (shown with a straight line) for SFM and HPS-SFM, FIG. 6E depicts pair-wise statistics and a decision boundary (shown with a straight line) for SFM-SWING and HPS-SFM, and FIG. 6F depicts pair-wise statistics and a decision boundary (shown with a straight line) for SFM-SWING and SFM.

In these cases, a third-order polynomial kernel function may separate the two classes in the $\Re^4$ space. In applying an SVM, fusion logic 60 may determine an optimal decision hyperplane given by:

$$\sum_{i=1}^{N_s} \lambda_i d_i (1 + v^T v_i^{(s)})^3 = 0$$

where $d_i \in \{1,-1\}$ represents a class name, $v_i^{(s)}$ are support vectors, $N_s$ is the number of support vectors and $\lambda_i$ are Lagrange multipliers used on the derivation of the SVM algorithm.

Alternatively, fusion logic 60 may apply a simple binary hypothesis testing method to classify between speech and impulse noise. Specifically, an instantaneous impulsive noise detect signal indicating presence of impulse noise may be obtained as:

$$instIndDet[l] = \begin{cases} \text{True}, & \begin{matrix} \gamma_{Harm}[l] < Th_{Harm} \\ \gamma_{SFM}[l] > Th_{SFM} \\ \gamma_{HPS-SFM}[l] > Th_{HPS-SFM} \\ \gamma_{SFMSwing}[l] < Th_{SFMSwing} \end{matrix} \\ \text{False}, & \text{otherwise} \end{cases}$$

where $Th_x$ are corresponding thresholds for each of the various parameters.

As shown in FIG. 5, second processing stage 52 may include a validation block 61. Validation block 61 may validate a detected signal burst as impulsive noise by counting a number of instantaneous impulsive noise detects Instantaneous indDet during a preset validation period comprising a predetermined period of time. If the instantaneous impulsive noise detect count exceeds a certain threshold minimum, validation block 61 may determine that the signal burst is an impulsive noise and output a signal indDet indicative of a determination of impulsive noise.

When an impulsive noise is detected and validated, an audio system comprising a voice activity detector having an impulsive noise detector may modify a characteristic (e.g., amplitude of the audio information and/or spectral content of the audio information) associated with audio information being processed by the audio system in response to detection of a noise event. In some embodiments, such characteristic may include at least one coefficient of a voice-based processing algorithm including at least one of a noise suppressor, a background noise estimator, an adaptive beamformer, dynamic beam steering, always-on voice, and a conversation-based playback management system.

Figure 7:
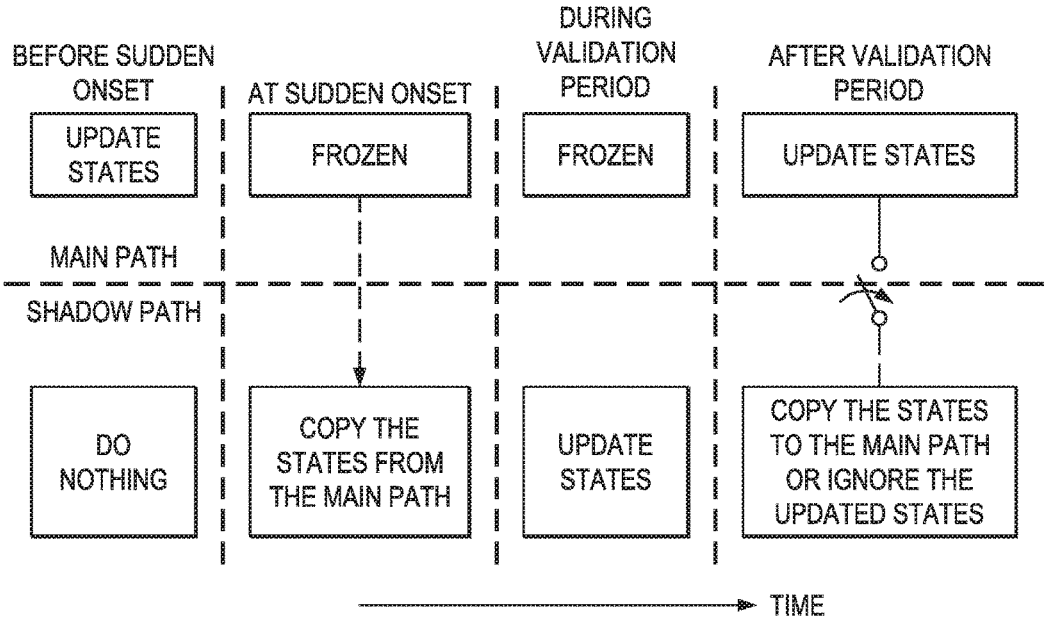
FIG. 7 illustrates a timing diagram illustrating selected functionality of a latency mitigation module, in accordance with embodiments of the present disclosure.

The preset validation period required to validate a signal burst as impulsive noise may introduce decision latency. Such latency may become critical for some applications such as noise suppression and the beamforming applications. Accordingly, impulsive noise detector 50 may include a latency mitigation module 62 that may mitigate the effects of this latency with a shadow-update processing approach. FIG. 7 illustrates a timing diagram of selected functionality of latency mitigation module 62, in accordance with embodiments of the present disclosure. As shown in FIG. 7, during normal operation of an audio processing system that implements a state-based processing algorithm, a main processing path may continuously update state information of the state-based processing algorithm that depends on control signals from a voice activity detector (e.g., a playback management system, a steered response power based beamsteering system, a multi-channel signal enhancement system, etc.). However, upon detection of a signal burst by sudden onset detector 53, latency mitigation module 62 may freeze such state information in the main processing path and copy such state information to a shadow processing path. During the validation period of validation block 61, latency mitigation module 62 may continue to freeze state information in the main processing path and update state information in the shadow processing path as if normal operation were occurring. If validation block 61 validates a signal burst event as an impulsive noise event during the validation period, then at the end of the validation period, latency mitigation module 61 may unfreeze the state information in the main path and cause the state-based processing algorithm to use the unfrozen state information as the state information of the state-based processing algorithm. On the other hand, if validation block 61 does not validate a signal burst event as an impulsive noise event during the validation period, then at the end of the validation period, latency mitigation module 62 may cause the state-based processing algorithm to use the shadow state information as modified by the shadow processing as the state information of the state-based processing algorithm.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments likewise, with the benefit of this disclosure, will be apparent to those having ordinary skill in the art, and such embodiments should be deemed as being encompassed herein.

What is claimed is:

1. An integrated circuit for implementing at least a portion of an audio device, comprising:

an audio output configured to reproduce audio information by generating an audio output signal for communication to at least one transducer of the audio device;

a microphone input configured to receive an input signal indicative of ambient sound external to the audio device; and a processor configured to implement an impulsive noise detector comprising:

a sudden onset detector for predicting an occurrence of a signal burst event of the input signal; and an impulsive detector for determining whether the signal burst event comprises a speech event or a noise event based on whether a threshold minimum of instantaneous noise events are detected within a validation period comprising a selected period of time;

wherein the processor is further configured to implement a latency mitigation module configured to:

freeze state information of state-based processing associated with the audio device during the validation period in response to the sudden onset detector predicting the occurrence of the signal burst event;

during the validation period, perform shadow processing using the frozen state information as shadow state information; and if the signal burst event is validated as a noise event, unfreeze the state information for use by the state-based processing;

wherein, in response to a determination that the signal burst event comprises a speech event, the integrated circuit is configured to cause the audio device to respond to the speech event by adapting a response of at least one component selected from the group consisting of a noise suppressor component, a background noise estimator component, an adaptive beamformer component, a dynamic beam steering component, an always-on voice detection component, and a conversation-based playback management component.

2. The integrated circuit of claim 1, wherein the processor is further configured to modify a characteristic associated with the audio information in response to detection of a noise event.

3. The integrated circuit of claim 2, wherein the characteristic comprises one or more of an amplitude of the audio information and spectral content of the audio information.

4. The integrated circuit of claim 2, wherein the characteristic comprises at least one coefficient of a voice-based processing algorithm including at least one of a noise suppressor, a background noise estimator, an adaptive beamformer, dynamic beam steering, always-on voice detection, and a conversation-based playback management system.

5. The integrated circuit of claim 1, wherein the impulsive detector is configured to evaluate harmonicity, sparsity, and degree of temporal modulation of a signal spectrum of the input signal to determine whether the signal burst event comprises a speech event or a noise event.

6. The integrated circuit of claim 1, wherein the latency mitigation module is further configured to:

if the signal burst event is not validated as a noise event, at the end of the validation period, cause the state-based processing to use the shadow state information as modified by the shadow processing as the state information.

7. An impulsive noise detection system comprising a processor configured to:

receive an input signal indicative of ambient sound external to an audio device;

predict an occurrence of a signal burst event of the input signal;

determine whether the signal burst event comprises a speech event or a noise event based on whether a threshold minimum of instantaneous noise events are detected within a validation period comprising a selected period of time;

freeze state information of state-based processing during the validation period in response to the predicted occurrence of the signal burst event;

during the validation period, perform shadow processing using the frozen state information as shadow state information;

in response to a determination that the signal burst event comprises a noise event, unfreeze the state information for use by the state-based processing; and in response to a determination that the signal burst event comprises a speech event, cause the audio device to respond to the speech event by adapting a response of at least one component selected from the group consisting of a noise suppressor component, a background noise estimator component, an adaptive beamformer component, a dynamic beam steering component, an always-on voice detection component, and a conversation-based playback management component.

8. The system of claim 7, wherein the processor is further configured to modify a characteristic associated with audio information reproduced by the audio device in response to detection of a noise event.

9. The system of claim 8, wherein the characteristic comprises one or more of an amplitude of the audio information and spectral content of the audio information.

10. The system of claim 8, wherein the characteristic comprises at least one coefficient of a voice-based processing algorithm including at least one of a noise suppressor, a background noise estimator, an adaptive beamformer, dynamic beam steering, always-on voice detection, and a conversation-based playback management system.

11. The system of claim 7, wherein determining whether the signal burst event comprises a speech event or a noise event comprises evaluating harmonicity, sparsity, and degree of temporal modulation of a signal spectrum of the input signal to determine whether the signal burst event comprises a speech event or a noise event.

12. The system of claim 7, wherein the processor is further configured to:

if the signal burst event is not validated as a noise event, at the end of the validation period, cause the state-based processing to use the shadow state information as modified by the shadow processing as the state information.

* * * * *